US006823688B1

(12) United States Patent
Chiu

(10) Patent No.: US 6,823,688 B1
(45) Date of Patent: Nov. 30, 2004

(54) REFRIGERANT FILLER CASING STRUCTURE

(76) Inventor: Shu-Lin Chiu, P.O. Box 36-80, Taichung City (TW)

( * ) Notice: Subject to any disclaimer, the term of this patent is extended or adjusted under 35 U.S.C. 154(b) by 0 days.

(21) Appl. No.: 10/772,730

(22) Filed: Feb. 4, 2004

(51) Int. Cl.[7] ..... F25B 45/00
(52) U.S. Cl. ..... 62/292; 62/77
(58) Field of Search ..... 62/77, 149, 292

(56) References Cited

U.S. PATENT DOCUMENTS 3,299,468 A * 1/1967 Moore ..... 425/174.4
3,645,496 A * 2/1972 Rawlins ..... 251/148
3,785,163 A * 1/1974 Wagner ..... 62/77
3,916,641 A * 11/1975 Mullins ..... 62/292
5,540,254 A * 7/1996 McGowan et al. .... 137/315.01

* cited by examiner

*Primary Examiner*—Melvin Jones
(74) *Attorney, Agent, or Firm*—Charles E. Baxley

(57) ABSTRACT

A refrigerant filler casing structure comprises a container, having a pressure gauge accommodating groove, a main body accommodating groove, a connector accommodating groove, and a duct accommodating groove sequentially disposed therein; the main body accommodating groove is used for mounting the main body of the filler; the high pressure gauge and low pressure gauge are disposed in the pressure gauge accommodating groove; the high pressure connector, low pressure connector, refrigerant connector, and vacuum connector are disposed in the connector accommodating groove; and the refrigerant duct substantially in a coiled condition is disposed in the duct accommodating groove; and a lid, having one side movably opened and closed is coupled to one side of the container, and the lid covers the duct accommodating groove when the lid covers the container; and an opening is disposed at the bottom of the lid.

12 Claims, 5 Drawing Sheets

REFRIGERANT FILLER CASING STRUCTURE

FIELD OF THE INVENTION

The present invention relates to a refrigerant filler related accessory, more particularly to a casing structure designed for refrigerant fillers.

BACKGROUND OF THE INVENTION

In general, a prior-art refrigerant filler as shown in FIG. 1 having a main body in rectangular shape comprises a high pressure connector, a low pressure connector, and a refrigerant connector interconnectably disposed at the bottom of the main body; a vacuum connector (not shown in the figure) disposed at the front end of the main body; a left blocking connector and a right blocking connector installed on both sides of the main body; a high pressure knob, a low pressure knob, and a transparent cover member installed in the front side of the main body; and a high pressure gauge and a low pressure gauge installed at the top surface of the main body.

The foregoing high pressure connector, low pressure connector, and refrigerant connector are individually connected to a refrigerant duct when refrigerants are filled. For high pressure refrigerant filling, the low pressure knob should be turned off and the high pressure knob and vacuum connection should be turned on for the vacuum operation. Then, the vacuum connector is turned off and the high pressure refrigerant cylinder (not shown in the figure) is turned on, so that the refrigerant enters into the passage inside the main body, and fills a refrigerant cylinder (not shown in the figure) through the high pressure connector and its refrigerant duct. The high pressure knob and low pressure knob can control the flow of the refrigerant, and the filling process can be observed through the transparent plate of the transparent cover member. The main body can further comprise a hanging hook that allows users to hang the filler at an appropriate operating position.

The aforementioned filler is facing a problem of getting damaged very easily, since the whole filler and its ducts are exposed to the outside, any one of the components on the filler may be damaged by external force during its transportation, operation, or storage. It creates lots of problems for maintaining the filler and replacing components, and also greatly reducing the life of its use.

SUMMARY OF THE INVENTION

The primary objective of the present invention is to provide a casing structure specially designed for protecting the aforementioned refrigerant filler. The filler is fixed in the casing, so that all components and ducts on the filler have sufficient protection, and greatly reducing the damage caused by collisions of improper external forces.

Another objective of the present invention is to provide a refrigerant filler casing having a lid that just covers the duct accommodating groove and the ducts, when the refrigerant filler casing is covered by the lid. A main idea is to show the components on the refrigerant filler, which allows users to identify casing as one containing the refrigerant filler without opening the lid, and thus will not mix such casing with other toolboxes. Another main idea is to pass refrigerant ducts through an opening of the lid during the operation of filling refrigerant provided that the lid can still cover the container and users can still operate and check the components on the refrigerant filler.

The main technical characteristics of the present invention are described as follows:

A refrigerant filler casing structure comprises a main body, and the main body having a high pressure connector, a low pressure connector, and a refrigerant connector individually disposed on the bottom side of the main body and individually connected to a refrigerant duct, and the refrigerant duct being interconnected in a three-way connection and its front end having a vacuum connector; a left blocking connector and a right blocking connector being disposed on both sides of the main body; a high pressure knob, a low pressure knob, and a transparent cover member individually disposed on the front side of the main body; and a high pressure gauge and a low pressure gauge being individually installed at the top side of the main body; and the casing structure comprises:

a container, having a pressure gauge accommodating groove, a main body accommodating groove, a connector accommodating groove, and a duct accommodating groove sequentially disposed therein; the main body accommodating groove being used for mounting the main body of the filler; the high pressure gauge and low pressure gauge being disposed in the pressure gauge accommodating groove; the high pressure connector, low pressure connector, refrigerant connector, and vacuum connector being disposed in the connector accommodating groove; and the refrigerant duct being substantially in a coiled condition and disposed in the duct accommodating groove; and a lid, having one side movably opened and closed, and coupled to one side of the container, and the lid covering the duct accommodating groove when the lid covering the container.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
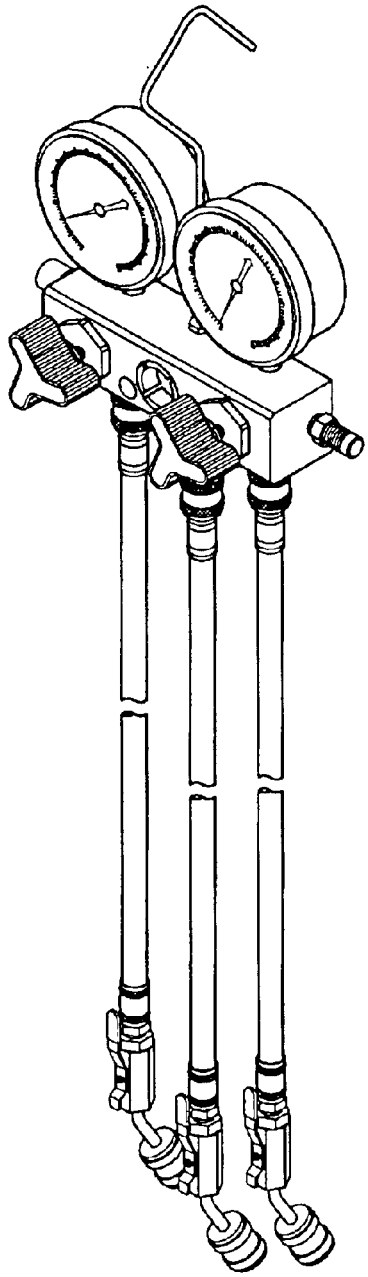
FIG. 1 PRIOR ART
FIG. 1 is a perspective view of prior-art refrigerant filler.
Figure 2:
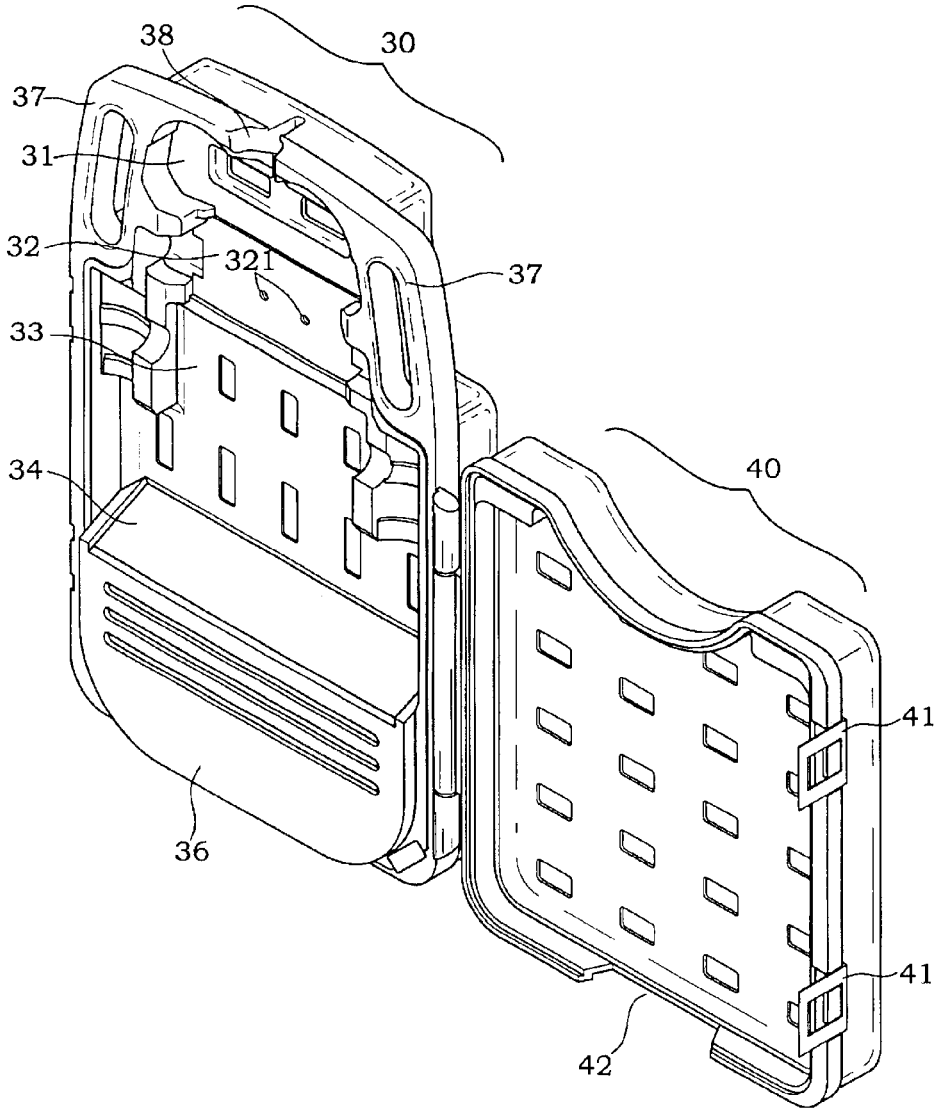
FIG. 2 is a perspective view of the casing of the present invention when it is opened.
Figure 3:
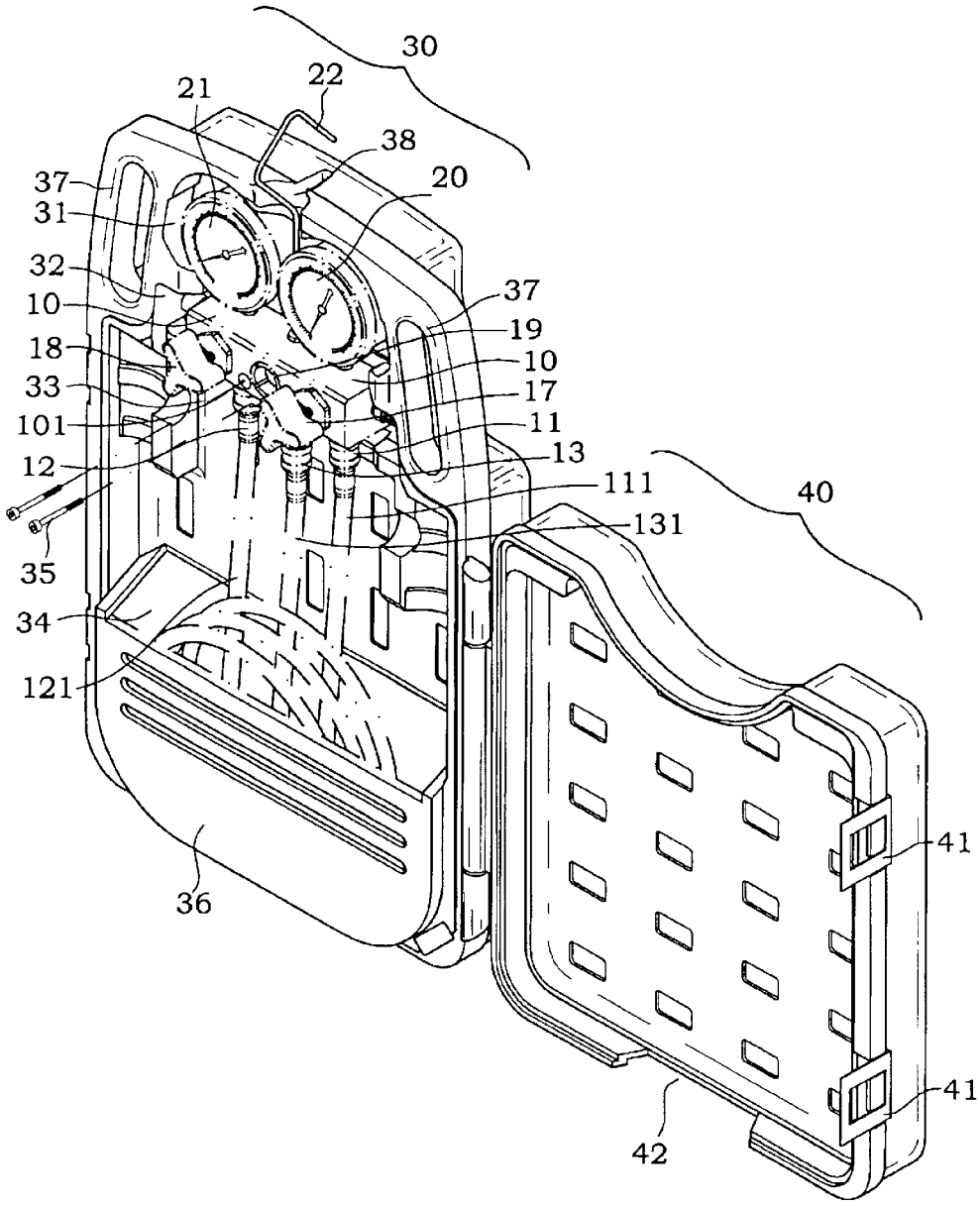
FIG. 3 is a perspective view of the interior of a casing of the refrigerant filler of the present invention.
Figure 4:
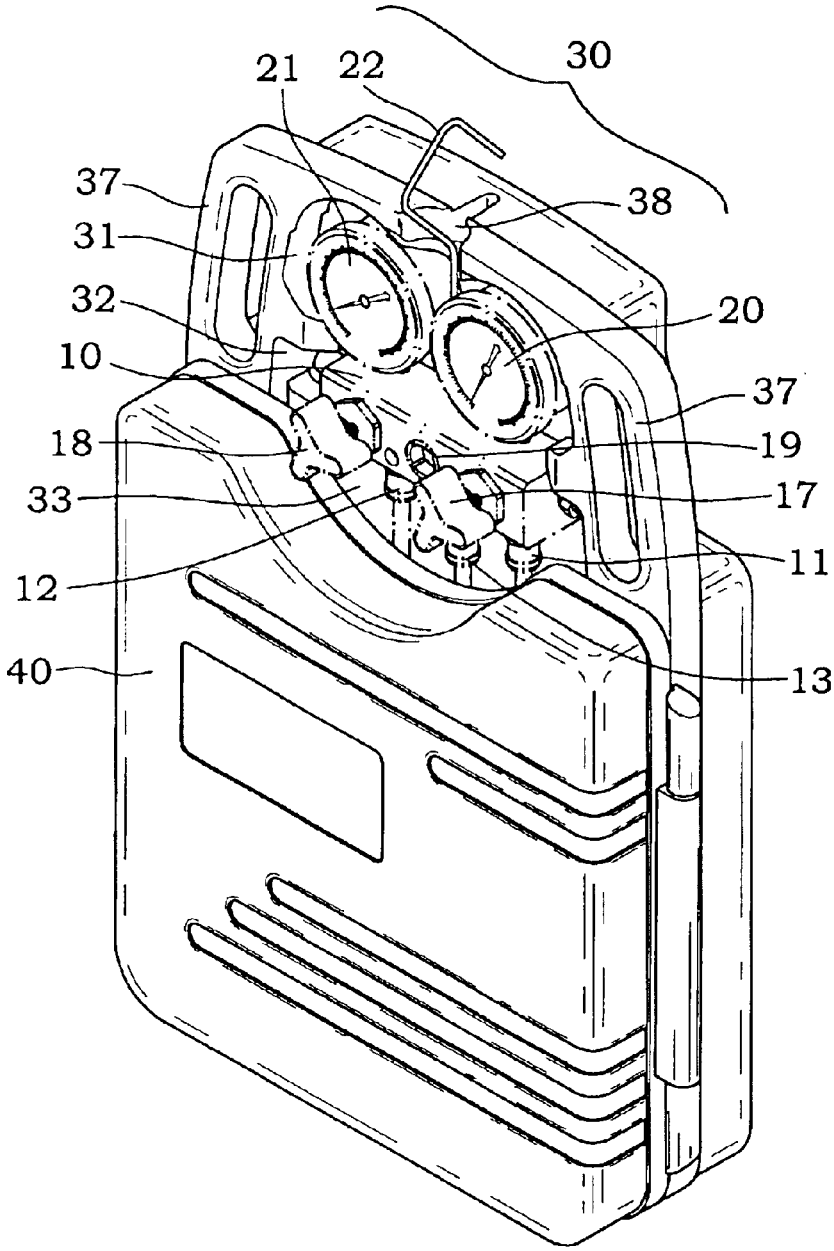
FIG. 4 is another perspective view of the interior of a casing of the refrigerant filler of the present invention.
Figure 5:
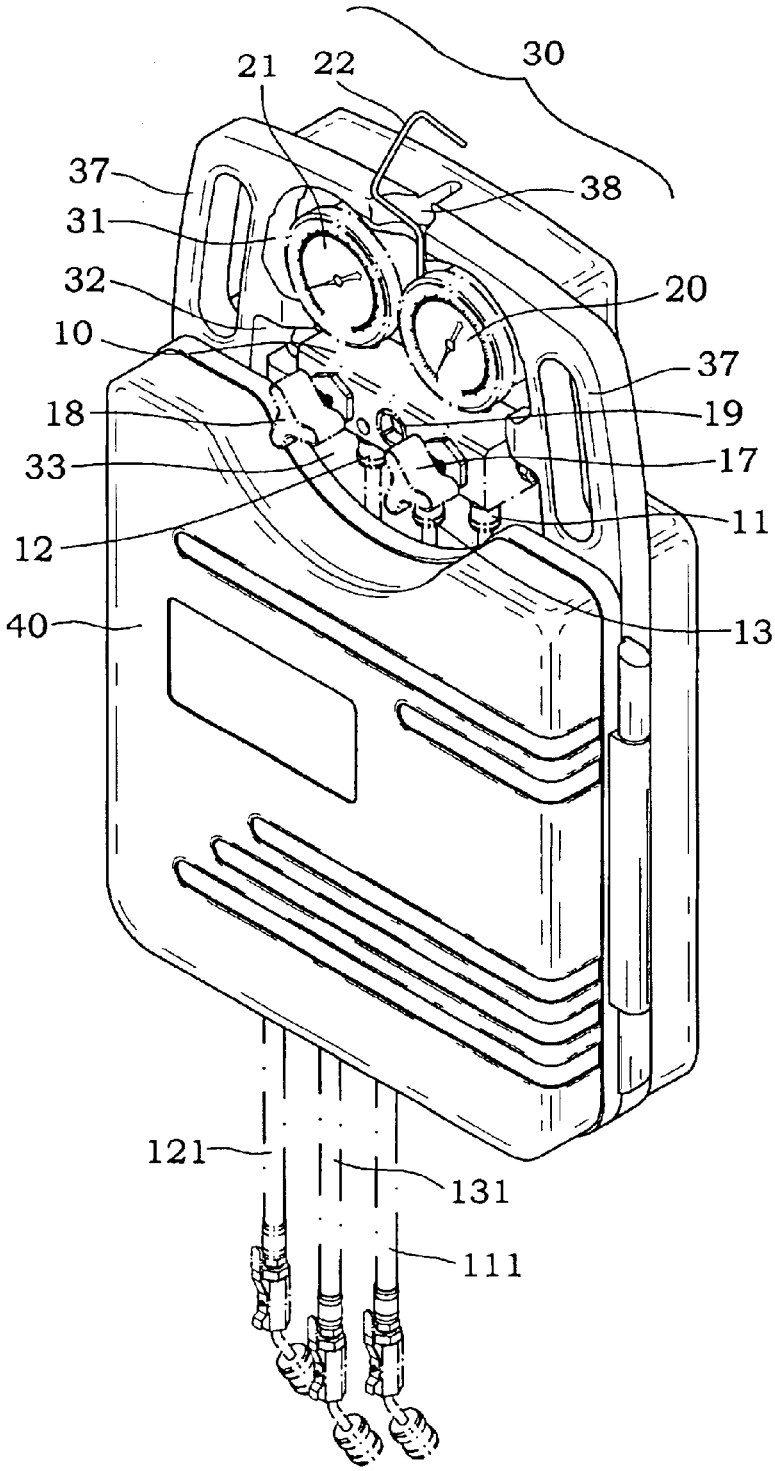
FIG. 5 is a perspective view of the refrigerant filler of the present invention when it is in use.

Please refer to FIGS. 2 and 3 for a casing structure designed for the foregoing refrigerant filler of the invention. The casing structure of the invention comprises:

a container 30, being integrally formed by plastic injection and having a pressure gauge accommodating groove 31, a main body accommodating groove 32, a connector accommodating groove 33, and a duct accommodating groove 34; the main body accommodating groove 32 comprises at least two threaded holes 321 at the bottom of the groove, and the main body 10 of the filler according to a prior art also has two through holes 101 disposed at a position without being interconnected to the refrigerant channel, such that two screw members 35 passing through the main body and being secured into the threaded holes 321 to secure the main body into the main body accommodating groove 32. Once the main body 10 is fixed into the accommodating groove 32, the high pressure gauge 20 and the low pressure gauge 21 will be located in the gauge accommodating groove 31, and the high pressure connector (11), the low pressure connector 12, the refrigerant connector 13, and the vacuum connector on the main body will be located in the connector groove 33. The refrigerant ducts 111, 121, 131 are substantially in a coiled state and located in the duct accommodating groove 34, and the container 30 has a handle section 37 disposed at the outer side adjacent to the pressure gauge accommodating groove 31 and the main body accommodating groove 32 for users to carry the casing. The container 13 at its top has a groove opening 38 for passing a hanging hook 22 through;

a lid 40 as shown in FIGS. 2, 3, and 4 with one side movably opened and closed, and connected to an outer side of the container 30, and the lid 40 fully covering the duct accommodating groove 34 when covering the container 30; in other words, the main body 10, high pressure knob 17, low pressure knob 18, transparent cover member 19, high pressure gauge 20, low pressure gauge 21, high pressure connector 11, low pressure connector 12, and refrigerant connector are exposed to the outside when the container 30 is covered by the lid 40; two buckles 41 are formed on the opening and closing edges of the container 30 and the lid 40 is buckled into a fixed position. Further, an opening 42 is disposed at the bottom of a lid 40 for receiving the refrigerant ducts 111, 121, 131 when the refrigerant is filled, provided that the lid still covers the container 30.

The filler is fixed in the casing, so that all components and ducts can have sufficient protection and thus greatly reducing any possible damage caused by improper external collisions when the refrigerant filler is carried, operated, or stored. The casing also has a handle 37, so that users can carry the refrigerant filler and the casing together. When the lid 40 is covered, it fully covers the duct accommodating groove 34 and the ducts 111, 121, 131 therein, so that the pressure gauges 20, 21, the knobs 17, 18, the connectors 11, 12, 13, and the transparent cover member 19 can be exposed to the outside, and users need not to open the casing to identify it as the refrigerant filling accessory. Another purpose is to pass the refrigerant ducts 111, 121, 131 through the opening 42 of the lid 40 in order to reduce the occupying space during the refrigerant filling operation, therefore exposing the foregoing components out of the casing is very important for users to control, operate, and check the refrigerant filler. The casing of the operating refrigerant filler can be placed horizontally at an operating site or hung at a stand with a hanging hook 22 at an operating location.

In summation of the above description, the present invention enhances the performance of the conventional structure, and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A refrigerant filler casing structure having a main body, a high pressure connector, a low pressure connector, and a refrigerant connector disposed at the bottom of said main body and individually coupled to a refrigerant duct, and said refrigerant duct being interconnected in a three-way connection and having a vacuum connector at its front end, a high pressure knob, a low pressure knob, and a transparent cover member installed on the front side of said main body, and a high pressure gauge and a low pressure gauge installed at the top side of said main body, and said casing structure comprising:

a container, having a pressure gauge accommodating groove, a main body accommodating groove, a connector accommodating groove, and a duct accommodating groove sequentially disposed therein; a closed panel on the surface corresponding to said duct accommodating groove; and said main body accommodating groove being used for mounting said main body; said high pressure gauge and low pressure gauge being disposed in said pressure gauge accommodating groove; said high pressure connector, slow pressure connector, refrigerant connector, and vacuum connector being disposed in said connector accommodating groove; and said refrigerant duct substantially in a coiled condition being disposed in said duct accommodating groove.

2. The refrigerant filler casing structure of claim 1 further comprising a lid with one side movably coupled to one side of said container.

3. The refrigerant filler casing structure of claim 2, wherein said lid covers said duct accommodating groove when said lid covers said container.

4. The refrigerant filler casing structure of claim 3, wherein said lid comprises an opening disposed at the bottom of said lid for passing said refrigerant duct through during the operation.

5. The refrigerant filler casing structure of claim 1, wherein said container at its bottom comprises at least two threaded holes and said body of said refrigerant filler comprises two through holes for passing two screw members through said through holes of said main body and latching into said threaded holes to secure said refrigerant filler into said main body accommodating groove.

6. The refrigerant filler casing structure of claim 1, wherein said container comprises a handle disposed on the outer side adjacent to said pressure gauge accommodating groove and said main body accommodating groove.

7. The refrigerant filler casing structure of claim 1, wherein said container at its top comprises a groove opening for passing a hanging hook of said refrigerant filler.

8. A refrigerant filler casing structure having a main body, a high pressure connector, a low pressure connector, and a refrigerant connector disposed at the bottom of said main body and individually coupled to a refrigerant duct, and said refrigerant duct being interconnected in a three-way connection and having a vacuum connector at its front end, a high pressure knob, a low pressure knob, and a transparent cover member installed on the front side of said main body, and a high pressure gauge and a low pressure gauge installed at the top side of said main body, and said casing structure comprising:

a container, having a pressure gauge accommodating groove, a main body accommodating groove, a connector accommodating groove, and a duct accommodating groove sequentially disposed therein; said main body accommodating groove being used for mounting said main body; said high pressure gauge and low pressure gauge being disposed in said pressure gauge accommodating groove; said high pressure connector, slow pressure connector, refrigerant connector, and vacuum connector being disposed in said connector accommodating groove; and said refrigerant duct substantially in a coiled condition being disposed in said duct accommodating groove; and a lid, having one side movably coupled to one side of said container, and covering said duct accommodating groove when said lid being covered onto said container, and said lid comprising an opening at the bottom of said lid.

9. The refrigerant filler casing structure of claim 8, wherein said container at its bottom comprises at least two threaded holes and said body of said refrigerant filler comprises two through holes for passing two screw members through said through holes of said main body and latching into said threaded holes to secure said refrigerant filler into said main body accommodating groove.

10. The refrigerant filler casing structure of claim 8, wherein said container comprises a handle disposed on the outer side adjacent to said pressure gauge accommodating groove and said main body accommodating groove.

11. The refrigerant filler casing structure of claim 8, wherein said container at its top comprises a groove opening for passing a hanging hook of said refrigerant filler.

12. The refrigerant filler casing structure of claim 8, wherein said container comprises a closed panel disposed on the surface corresponding to said duct accommodating groove.

* * * * *